United States Patent [19]

Kun

[11] 4,334,218

[45] Jun. 8, 1982

[54] MOTION SENSING CIRCUIT ESPECIALLY FOR ALARM DEVICES

[76] Inventor: Akos Kun, Hernad u. 7., 1078 Budapest, Hungary

[21] Appl. No.: 194,779

[22] Filed: Oct. 7, 1980

[51] Int. Cl.[3] ..... G08B 13/02

[52] U.S. Cl. ..... 340/689; 200/61.47; 200/61.93; 340/541; 340/545

[58] Field of Search ..... 340/689, 571, 568, 545, 340/541, 65; 200/61.47, 61.52, 61.93

[56] References Cited

U.S. PATENT DOCUMENTS

| | | | |
|---|---|---|---|
| 3,599,745 | 8/1971 | Hughes | 200/61.47 |
| 3,962,696 | 6/1976 | Smith et al. | 200/61.93 |
| 3,997,890 | 12/1976 | Kendrick, Jr. | 340/513 |
| 4,042,796 | 8/1977 | Zink | 200/61.93 |

*Primary Examiner*—Glen R. Swann, III

[57] ABSTRACT

A motion sensing circuit has a plurality of motion sensitive switches connected serially therein and which conduct a quiescent current through the circuit in one stable condition whereas in another stable condition of said switch above a upper limit of the tripping, the quiescent current flow is re-established and, in between the current through the switch is interrupted. In both stable conditions the switch represents a short circuit, that is current flows through the circuit, while between the two stable conditions the current is interrupted and a registering device at the output of the circuit will sense such tripped or alarm condition.

The switches according to the present invention employ mercury as the moving contact and a pair of rotational body-shaped rest contacts within the tripping sensitive switch. The rotational body-like shaping of the motion sensing switch causes the mercury to flow from one stable condition into the other during the tripping quickly. With the aid of a contact stub protruding from one of the rest contacts, an interruption of the current between the two contacts during tripping is provided.

The motion sensing apparatus according to the present invention finds application in automobiles, buildings, and other structures as an alarm device wherein a plurality of switches can be placed at various locations and perform the observation of the object assigned independently of each other.

6 Claims, 10 Drawing Figures

MOTION SENSING CIRCUIT ESPECIALLY FOR ALARM DEVICES

FIELD OF THE INVENTION

The present invention relates to a motion sensitive circuit, especially for use in alarm devices in which at least a pair of mechanically constructed and motion sensitive switching elements are incorporated and are in series connection with respect to each other and supplied by electric energy in a rest current loop, while the rest current loop is coupled to a unit for the registration of the motion. The invention encompasses also the novel-type switches which can be used in connection with the motion sensitive circuits according to the present invention.

The motion sensitive circuit according to the present invention can be advantageously used in alarm devices built into automobiles, buildings or other constructions and also in cases where the fact of dislocation or movement of the individual switching elements must be observable independently from each other.

BACKGROUND OF THE INVENTION

A number of types of motion sensitive circuits became known which can be grouped into two main groups according to the connection of the switching elements sensing the motion or dislocation. The first group includes the so-called rest current-type sensors. The sensors employed in such group include such mechanical switching elements which in their rest position are in a closed circuit position and upon dislocation or movement, will go over into an open circuit position, consequently, the change of state of the sensors is indicated by the interruption of the current which used to flow through them.

The second group includes the so-called operating current-type sensors which are connected parallel with respect to each other and are connected to a voltage source. The sensors employed in this group are open circuited switches in their rest position, while upon dislocation or movement, the voltage appearing across their terminals becomes shorted. The current which starts to flow through the loop will indicate that the sensors have undergone a change of state.

Both groups have a common characteristic in that all the sensing switches are similar and in their alarm state, that is, in their dislocated or moved condition, they will prevent the operation of the remaining switches.

The reliability of property protecting circuits requires that the sensors of a protecting system should be able to operate independently from each other because with such possibility, the protection is greatly enhanced. Intruders or unauthorized persons can easily disarm or put out of operation a system which is sensitive only to a single intrusion and, thereafter, such system is unable to offer any kind of protection whatsoever against a repeated unauthorized intrusion.

Switching constructions or sensors became known which operate independently from each other and according to such constructions the switching elements or sensors are connected individually to independent registering units or an appropriately coded signal transmission has been incorporated into them. Both of such structures make the switching operation as well as the location and the control of the devices complicated.

For this reason such systems did not enjoy a wide acceptance.

It is a known and presently widely used solution according to which each of the switching elements placed in a sensing loop, operating with a rest current, are shunted by a resistance having a certain magnitude. As a result, the change of state of the individual switching elements is indicated not by the interruption of the current, but by the gradual decrease of the loop current. The disadvantage of such constructional solution resides in that upon the activation of a few sensing elements or in the event of their defect, the loop current will be reduced to such an extent that the registering unit will not be able to perform its required function.

OBJECTS OF THE INVENTION

It is an object of the present invention to provide a motion or dislocation sensitive circuit which, while retaining the simplicity and the advantages of the rest current type loops or sensing chains, is still capable of observing the indications of the independently located motion sensing elements even after several or one of the other sensors have been already dislocated or moved.

It is also an object of the present invention to provide such a motion sensitive switching apparatus which is especially adapted for use within the novel-type motion sensitive circuit according to the present invention and the construction of which is not more complicated than that of the known widely used switching elements.

SUMMARY OF THE INVENTION

The present invention rests on the recognition of the fact that for the sensing of a dislocation it is sufficient to indicate the fact of the dislocation and, for such fact, the impulse-like interruption of the rest current is sufficient. Following the interruption, the sensor will assume a closed circuit position and will be ready for a subsequent sensing operation.

The present invention provides a motion sensing circuit especially for alarm devices comprising at least a pair of mechanically constructed motion sensitive switching elements connected in series and are placed into a electrically energized rest current loop coupled to a dislocation registering unit in which, according to the present invention, the switching elements comprise a pair of stable state switches which, upon movement of dislocation, will go over from one of the stable position into another position and, having a pair of outputs which, in both stable state, indicate a short circuit, while in the dislocated state will indicate an open circuit, while in the unit registering the dislocation there is provided an impulse sensing circuit observing the movement of the switching elements.

The present invention in one of its preferred embodiments provides that the rest current loop is coupled to the impulse sensing circuit through a differential device.

In another preferred embodiment of the motion sensing circuit there is coupled a light emitting element present for indicating the normal operation of a circuit and such element being directly coupled to the rest current loop or through a transistor.

In connection with the present invention I have also invented a novel motion sensing switch which can be advantageously used in connection with the above-described motion sensing circuit and to that effect such switch is provided with a pair of rest contacts and a moving contact made from electrically conducting liquid, preferably from mercury, and which connects the two rest contacts depending from the position of the switch. According to the present invention the switch comprises a pair of rest contacts which are shaped as rotational bodies and separated from each other by an insulating ring but being mechanically joined together. One of the rest contacts is a doubly curved rotational body having a cavity, the center recessed portion of which joining the other two curved segments thereof is formed with a lesser radius. Furthermore, both curved surfaces are concavely formed with respect to the borderline separating the two rest contacts and, the other rest contact is provided with a contact protruding into the center region of the recess formed in the other rest contact with the lesser radius. The liquid forming the moving contact has a volume which is less than the recess being formed with the lesser radius in one of the rest contacts, or at least it has the same volume.

The novel switch formed according to the above, in the event of a dislocation, for the period of the swinging motion during the dislocation, causes the current, to be interrupted in an impulse fashion, between the two stable conditions representing a short circuit which fact makes the switch adaptable for use in the motion sensing circuit.

BRIEF DESCRIPTION OF THE DRAWINGS

The invention will become more readily apparent from a detailed description of preferred embodiments thereof shown in the accompanying drawings, in which.

DESCRIPTION OF THE PREFERRED EMBODIMENTS

FIG. 1 illustrates with conventional circuit illustrations a switch having a pair of rest contacts, the opening and closing contacts, which are bridged by a conductor and, as a result, the switch will have two outputs. It can be readily seen that between the two outputs of the switch, in the two stable conditions of the moving contact, one may observe a short circuit and such short circuit will be interrupted only when the moving contact is tripped over from its rest position. I will describe hereinafter that from switches of this kind one may reliably construct the motion sensing circuit. By an expert in the field it can be readily seen that the switch by its principle of operation and as illustrated in FIG. 1*a* can be constructed also by shorting the rest contacts of known switches. This refers only to the schematic of FIG. 1*a*.

Figure 1A:
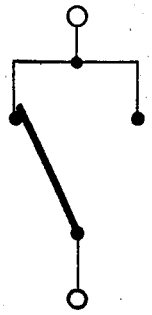
FIG. 1*a* illustrates a circuit diagram of the switching unit which can be used in the motion sensing circuit according to the present invention.
Figure 1B:
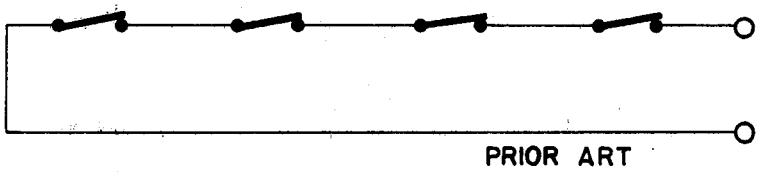
FIG. 1*b* is a circuit diagram of the motion sensing loop of the rest current type.
Figure 1C:
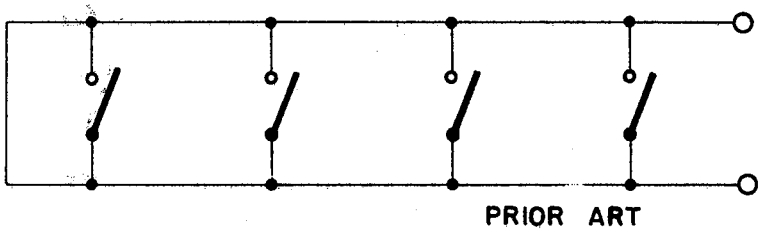
FIG. 1*c* is a circuit diagram of the motion sensing loop of the operating current type.

FIG. 1*b* illustrates a motion securing chain operating with the principle of rest current, while FIG. 1*c* illustrates a motion sensing chain or loop employing the operating current principle, the rest or operating current type switching elements of which, respectively are located independently from each other and can be sensing various movements or dislocations. In line with the introductory portion of our description, after the actuation of any one of the switching elements in the loop, the condition of the sensing loop will permanently change, which will prevent any further action by the remaining switching elements.

Figure 1D:
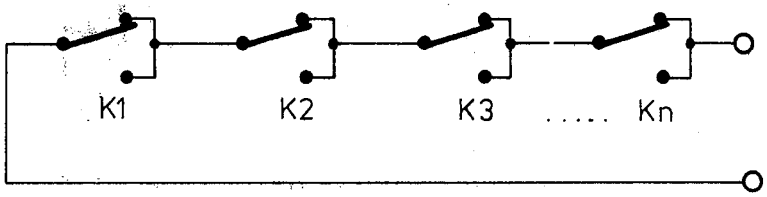
FIG. 1*d* is a circuit diagram of the sensing loop of the rest current type employing the switching units according to the present invention.

For the motion sensing circuit according to the present invention a sensing loop could be created by the combination of the loops of FIGS. 1*a* and 1*b*, as it is illustrated in FIG. 1*d*. The illustrated switches K1, K2, K3, and Kn are connected in series and into a closed loop. Each of the switches has two stable conditions and in their stable condition between their terminals there is a short circuit. During the dislocation of the moving contact of any one of the switches in FIG. 1*d* from one stable condition into the other stable condition, the current will be interrupted during the tripping instant. Such interruption which occurs in the form of an impulse lends itself available for giving off an alarm signal. After the disclosed switch was tripped into its other stable condition, the circuit becomes closed again and becomes available for similar operation.

For example, when the alarm sensing circuit according to the present invention is built into an automobile, the switches K1–Kn can be distributed among the doors of the automobile, with other switches being assigned to sense the dislocation of the sun roof or convertible roof, the engine hood or trunk lid. Upon unauthorized intrusion if the alarm which was sounded after one of the doors has been dislocated and, went unanswered, or the alarm has been shut off, another alarm will sound or will be indicated when another door or the engine hood or the trunk lid is opened by the intruder, or in the event, when the device according to the present invention is constructed as a motion sensing device, the alarm will go off when the automobile is brought into motion. The resetting or renewed tripping of a tripped switch when, for example, the door which has been opened unauthorized, is reclosed again, it will give rise to a new alarm.

Figure 2:
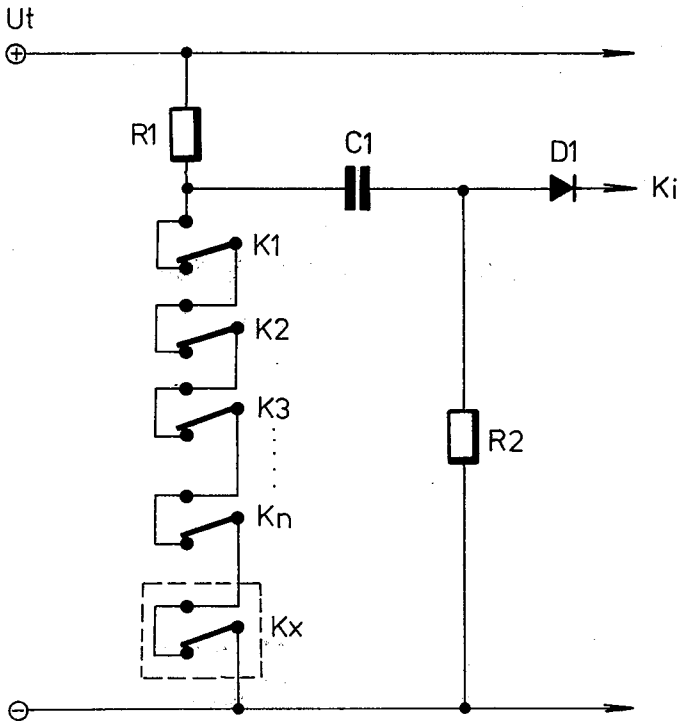
FIG. 2 is a circuit diagram of the rest current loop of the motion sensing circuit according to the present invention with a differential member, as an example.

FIG. 2 illustrates a motion sensing circuit comprising also a differential member and, in which the loop operating on the rest current principle and comprising switches K1–Kn are connected to a d.c. source through a operating resistance R1. The indicated Kx switch represents in the illustrated embodiment a forward swinging sensor which is especially useful in protecting automobiles and which can be advantageously constructed by using the novel switch member illustrated in FIGS. 6*a*, 6*b* and 7. The resistor R1 sets the rest current flowing through the loop. The differential member comprises capacitor C1 and resistor R2. The output of capacitor C1 and resistor R2 through a diode D1 is coupled to a registering unit for the registration of the dislocation or motion which is not illustrated in the drawing which, however, can give off, in any conventional manner, an alarm or other visual indication when registering a positive impulse resulting from the tripping of either one of the switches.

Figure 3:
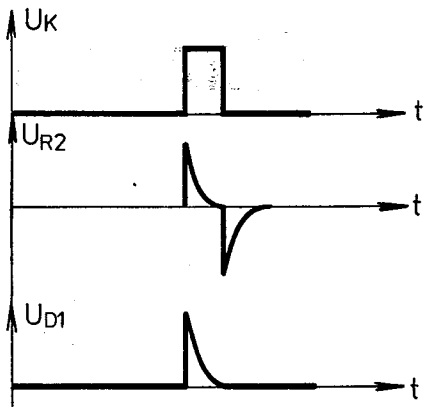
FIG. 3 illustrates the voltage forms of the circuit diagram according to FIG. 2, on a time scale.

FIG. 3 illustrates on a time scale the various voltages resulting during the tripping of one of the switches. The $U_K$ voltage can be measured at the input of the differential member and the $U_{R2}$ voltage can be measured at the output of the differential member. In order to avoid the mutually disturbing influence of the two voltage spikes, the negative going spike is clipped with the help of diode D1, as can be seen on the time diagram, as voltage $U_{D1}$.

Figure 5:
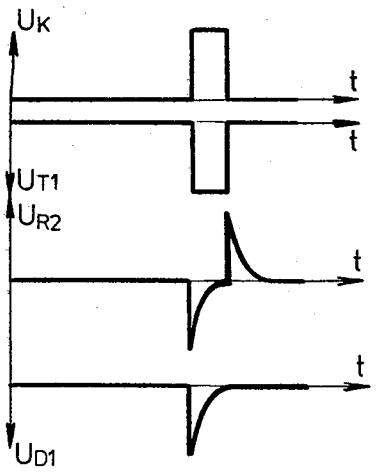
FIG. 5 illustrates the voltage forms at characteristic points on FIG. 4, on a time scale.
Figure 4:
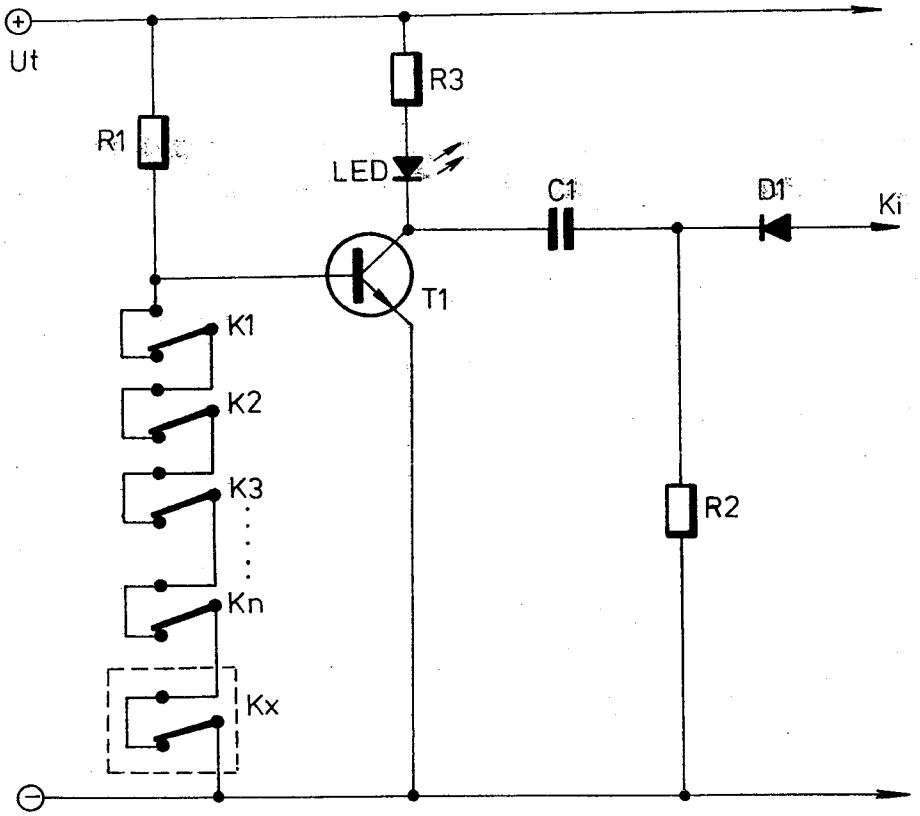
FIG. 4 is a circuit diagram similar to FIG. 2 incorporating the light emitting element controlling the reliability of the circuits.

FIG. 4 in principle is similar to FIG. 2 with the exception that between the motion sensing circuit according to the present invention and the differential member a transistor T1 is inserted. The collector of the transistor T1 is returned to the supply voltage source over resistor R3, and into the collector circuit, LED light emitting element is also included. There is another difference with respect to FIG. 2 in that the diode D1 is poled differently because, in this embodiment, it is more advantageous to retain the negative going spikes considering the network noises present. Due to the phase rotating effect of the transistor T1 the input pulse to the differential member (voltage $U_{T1}$ in FIG. 5) is poled oppositely with respect to FIG. 3. In the rest condition of the current at the base of transistor T1, one may measure ground potential and, there is no current flowing through it, while at the collector of the transistor T1 the full supply voltage will appear. In this case the light emitting element LED will not emit light. If any one of the sensing switches is tripped, then the rest current in the loop will be interrupted in a pulse-like fashion and transistor T1 will open up for this instant. Through the opened up or gated transistor T1 the light emitting element LED will give off light signals and, the differential member, as already described above, at its output will deliver a pulse for registration in the registering unit. In the event the sensing loop or circuit, operating on the principle of rest current, becomes interrupted due to some defect in the circuit, then the transistor T1 will open up or becomes gated and the collector current of the transistor will give rise to a continuing light signal by the light emitting element LED. Therefore, a continuous light signal indicates a defect in the sensing loop.

From the above described operation of the motion sensing circuit according to the present invention one may immediately see that its application can be had to a very wide area. In addition to the protection of property and alarm sounding, it can be used in cases where there is necessity to register a number of motions independently from each other. The concrete construction of the motion sensing switches employed in the circuit according to the present invention meets the above requirements, that is, the novel switches employed have been concretely constructed to be able to undergo the type of dislocation having a certain magnitude when tripped between the two stable positions, so that in both stable conditions the switch could have at its output a short circuit while during the tripping it should show an interruption.

Figure 6:
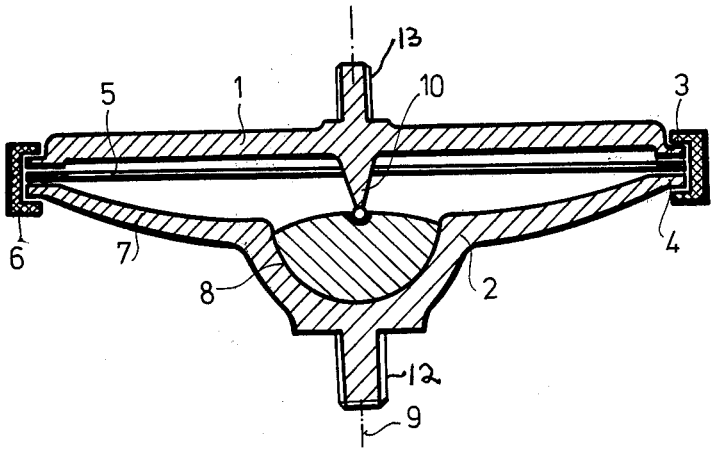
FIG. 6 illustrates the novel switch according to the present invention in a sectional view at its center.
Figure 7:
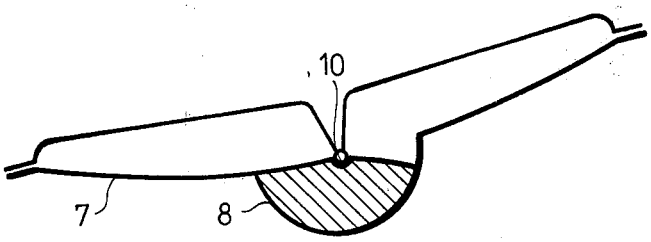
FIG. 7 is a schematic illustration of the switch of FIG. 6 is one of its borderline positions during operation.

Now reference should be had to FIG. 6 which illustrates the novel switch according to the present invention to be used in the motion sensing loop for sensing a dislocation or a swinging motion.

The switch illustrated in FIG. 6 has a first 1 and a second 2 rest contact which are formed as rotational body members lying oppositely each other and adjoining each other. Both rest contacts 1 and 2 are made from an electrically conducting material, preferably from metal, and in their oppositely lying position there is a switching chamber formed between the two rest contacts. The rest contacts 1 and 2 are separated from each other by an insulating ring 5 which is resting between their annular flanges 3 and 4, therefore, the rest contacts 1 and 2 are electrically insulated from each other. The two outputs of the rest contacts 1 and 2 are provided by their respective metallic bodies, that is, by their threaded extensions 12 and 13.

The entire assembly is held together by a plastic closing ring 6 which is tightly abutting against flanges 3 and 4 and tightly closes the inner switching space. The inner side of the rest contact 2 comprises two adjoining curved segments 7 and 8. The segments 7 and 8 are shaped as rotational bodies and have a common axis which lies along the axis 9 of the rest contacts 1 and 2. The centrally lying segment 8 has a radius of curvature which is much smaller than that of segment 7 and, as a result, it forms a reservoir for the liquid metal placed into the switching chamber, which is preferable mercury. From rest contact 1 in line with the axis 9, there protrudes a contact stub 10 the length of which is such that it extends substantially or slightly below the imaginary extension of the curved segment 7 up to the axis 9. The curved segments 7 and 8 are preferably spherical bodies.

The switch according to the present invention operates as follows: in the condition illustrated in FIG. 6, the contact 10 protruding into the mercury between rest contacts 1 and 2, causes a short circuit. It can be seen from the figure that such contact will be retained for quite some time even at minor dislocations of the switch into either direction until the dislocation or tripping will not have the magnitude illustrated in FIG. 7. In this case the liquid metal will reach just about the borderline between the segments 7 and 8 and the contact stub 10 barely protrudes into the liquid metal. If the tripping of the switch remains within such boundaries then due to the geometric considerations, the contacting stub 10 will still be able to protrude into the liquid metal. On the other hand, if the tripping will go beyond the borderline position illustrated in FIG. 7, then the liquid metal will flow out from the recess of segment 8 and will flow into the recess of segment 7. Due to the fact that the radius of curvature of segment 7 is much larger than that of segment 8, therefore, its surface is also larger, consequently the liquid spilling over onto segment 7 will spill over in a quantity which is much larger than the quantity remaining in segment 8. As a result, the liqud level in segment 8 will suddenly decrease and it will break the contact with the contact stud 10. The liquid metal spilling over onto segment 7 and flowing over its curved surface will collect over the surfaces of the contacts 1 and 2 as they adjoin near the insulating ring 5. This means that after a certain time following the tripping, the short circuit will be established again between contacts 1 and 2. In such fashion the equivalent circuit of the switch illustrated in FIGS. 6 and 7 will correspond to that shown in FIG. 1*a*. In the event the moving contact is mercury, the novel switch according to the invention meets excellently the requirements. The mercury which has a very heavy specific weight, due to its inertia, it is very adaptive to be used for sensing swinging motions, and it will not respond to high frequency oscillations. For example, when the switch and the sensing circuit according to the invention is used in an automobile, contrary to the well-known motion sensing devices resting on the pendulum principle, the switch according to the present invention, will not be influenced by the wind pressure or by the mechanical oscillations resulting from the normal highway traffic. Another advantage according to the present invention resides in its simple construction and easy manufacturing and its reliabilty. The appropriate shaping of the segments 7 and 8 and by appropriately selecting the volume of the liquid metal, the tripping limits can be set within an angle of 10°-60°.

Although the invention has been described in its preferred form with a certain degree of particularly, it will be understood that the present disclosure of the preferred embodiments has been made only by way of example and that numerous changes may be resorted to without departure from the true spirit and scope of the invention as hereinafter claimed. It is intended that the patent shall cover, by suitable expression in the appended claims, whatever features of patentable novelty exist in the invention disclosed.

What is claimed is:

1. An alarm apparatus for sensing a predetermined motion of an object under surveillance, comprising an electrical circuit energized by the flow of an electric current, at least one switching device included in said circuit and being of the type having a pair of stable current conducting positions for quiescently conducting said electric current and an unstable tripping or current blocking position for interrupting said electric current when said predetermined motion of object occurs, means for displaying the occurence of said current blocking position of said switching device as said alarm condition for said object, wherein a plurality of said switching devices are connected in series in said circuit, wherein a differentiating circuit branch is coupled before said display means, said differentiating circuit branch outputting said current blocking position of said switching device in the form of a pulse and, wherein said displaying means comprises a pulse sensing registration device.

2. The alarm apparatus as claimed in claim 1, wherein said circuit further comprises a light emitting element for displaying, upon selected actuation, the normal operating condition of said apparatus.

3. The alarm apparatus as claimed in claim 2, wherein said light emitting element is coupled to said circuit by means of a transistor device.

4. The alarm apparatus as claimed in claim 1, wherein each of said switching devices comprises a pair of rest contacts formed each as a body of rotation, means for insulating said pair of rest contacts from each other in a first of said stable positions, said rest contacts forming an inner switching chamber therebetween, sealing ring means tightly sealing the edges of said contacts and said chamber therebetween, one of said rest contacts comprising a reservoir shaped central segment for the storing of a liquid metal contact therein and an outer segment integrally joined to said central segment, said outer segment having a radius of curvature larger than the radius of curvature of said central segment, a contact stub protruding from the other of said rest contacts and into the liquid metal at said first to said stable positions, during said tripping position of said switching device said liquid metal flowing over onto said outer segment whereby current flow between said first and second rest contacts is interrupted, said second stable position establishing contact between said first and second rest contacts and occurring when said tripping goes beyond a predetermined limit, the quantity of said liquid metal contact is such that it retains contact with said contact stub below a predetermined limit of tripping and interrupts said current flow above said predetermined limit of tripping and thereafter establishes current flow again at said second stable position.

5. The alarm apparatus as claimed in claim 4, wherein said central segment and said outer segment are spherically shaped about a central axis of rotation of said switching device, said contact stub being formed along said central axis.

6. The alarm apparatus as claimed in claim 5, wherein each of said rest contacts comprises a terminal stub protruding outwardly therefrom along said central axis.

* * * * *